US006837229B2

(12) United States Patent
Mizutani et al.

(10) Patent No.: US 6,837,229 B2
(45) Date of Patent: Jan. 4, 2005

(54) IGNITION DEVICE FOR INTERNAL COMBUSTION ENGINE

(75) Inventors: Atsuya Mizutani, Yokkaichi (JP); Tetsuya Miwa, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/808,476

(22) Filed: Mar. 25, 2004

(65) Prior Publication Data

US 2004/0187854 A1 Sep. 30, 2004

(30) Foreign Application Priority Data

Mar. 31, 2003 (JP) ..... 2003-094991

(51) Int. Cl.[7] ..... F02P 15/08

(52) U.S. Cl. ..... 123/638; 123/640; 123/596; 123/605; 123/649; 123/650

(58) Field of Search ..... 123/605, 596, 123/638, 640, 649, 650

(56) References Cited

U.S. PATENT DOCUMENTS 2,025,203 A * 12/1935 Harper, Jr. ..... 123/638
4,201,173 A * 5/1980 Okada et al. ..... 123/638
4,407,259 A * 10/1983 Abo ..... 123/638
4,493,306 A * 1/1985 Asik ..... 123/640
4,892,080 A 1/1990 Morino et al.
4,958,616 A * 9/1990 Di Nunzio et al. ..... 123/638
5,146,905 A * 9/1992 Davis ..... 123/638
5,193,515 A * 3/1993 Oota et al. ..... 123/640
5,404,860 A 4/1995 Morino
5,445,122 A * 8/1995 Gerhard et al. ..... 123/638
6,536,406 B2 * 3/2003 Matsubara et al. ..... 123/638

* cited by examiner

*Primary Examiner*—Erick Solis
(74) *Attorney, Agent, or Firm*—Nixon & Vanderhye P.C.

(57) ABSTRACT

The ignition device for an internal combustion engine includes two spark plugs provided for each cylinder, ignition coils arranged independently to each of the spark plugs, an ignition power source circuit for supplying electrical energy to first coils which constitute the ignition coils, and an ignition transistor circuit for switching on and off the electrical supply from the ignition power source circuit to the first coils. In the ignition device, the first coils corresponding to spark plugs that are provided to the same cylinder are connected in parallel with the ignition transistor circuit that is arranged to each cylinder. The ignition power source circuit is a circuit including an energy storage condenser for storing electrical energy supplied to the first coil. The electrical supply circuit is a circuit including an MOS-type field effect transistor.

3 Claims, 3 Drawing Sheets

IGNITION DEVICE FOR INTERNAL COMBUSTION ENGINE

CROSS REFERENCE TO RELATED APPLICATIONS

This application is based upon, claims the benefit of priority of, and incorporates by reference Japanese Patent Application No. 2003-94991 filed Mar. 31, 2003.

BACKGROUND OF THE INVENTION

1. Field of the Invention

The present invention relates to an ignition device for an internal combustion engine for driving spark plugs arranged to each cylinder of the internal combustion engine.

2. Description of the Related Art

Generally, a conventional ignition device for an internal combustion engine is constructed with a plurality of spark plugs arranged to each cylinder. When an ignition device for an internal combustion engine is constructed as mentioned above and a plurality of spark plugs are used and are simultaneously ignited at a single cylinder, effects obtained are good combustion inside the cylinder, improvement of fuel efficiency, improved gas mileage, enabling of lean combustion, and the like (see, for example, Japanese Patent Laid-Open Publication No. Hei 1-232165, pp. 5–7, FIG. 3).

However, the ignition device for an internal combustion engine described above has the following problems. Namely, each spark plug is independently provided with an ignition coil, an electrical supply circuit for controlling the electrical supply to the ignition coil, and the like. Therefore, it is difficult to avoid an ignition device that increases in size and costs. Therefore, in a case where two spark plugs are arranged per cylinder, for example, the number of ignition coils and the number of electrical supply circuits will double compared to a construction where one ignition plug is furnished to one cylinder.

SUMMARY OF THE INVENTION

The present invention solves the above-mentioned problems. It is therefore an object of this invention to provide a low-cost, compact, and superior ignition device for an internal combustion engine.

In one aspect of the present invention, an ignition device for an internal combustion engine has a plurality of spark plugs provided to each cylinder of an internal combustion engine. Furthermore, an ignition coil is independently arranged corresponding to each of the spark plugs, while an ignition power source circuit supplies electrical energy to a first coil which is part of the ignition coil. Finally, the ignition device has an electrical supply circuit for switching on and off an electrical supply from the ignition power source circuit to the first coil. The ignition device is characterized in that the plurality of first coils corresponding to the plurality of spark plugs arranged to the same single cylinder are connected in parallel with the single electrical supply circuit arranged to each cylinder, and the electrical supply circuit simultaneously supplies electricity to the plurality of first coils corresponding to the plurality of spark plugs arranged to the same cylinder.

In the ignition device for an internal combustion engine of the present invention, the first coils corresponding to each spark plug arranged to the same cylinder are connected in parallel with the single electrical supply circuit that is arranged to each cylinder. In other words, the single electrical supply circuit controls the plurality of ignition coils corresponding to each of the spark plugs which are arranged to the same cylinder. Therefore, in the above-mentioned ignition device for an internal combustion engine, the number of the above-mentioned electrical supply circuits is the same as the number of cylinders in the internal combustion engine, and this enables the combustion efficiency to be improved, etc. when there are a plurality of spark plugs for each cylinder.

In general, in order to get the spark plug to generate spark, a large amount of energy is needed in an extremely short period of time. Therefore, a large-capacity element must be used to serve as a switching element (such as a transistor, for example) which constitutes the electrical supply circuit. A large-capacity switching element is normally expensive and large in size. Therefore, if the number of electrical supply circuits can be kept low, then this is helpful for keeping costs low and avoiding increases in size and the like in the ignition device for an internal combustion engine.

According to the present invention described above, it is possible to provide a superior ignition device for an internal combustion engine that meets the twin demands of being inexpensive and compact while also achieving high ignition performance.

In an ignition device for an internal combustion engine according to an embodiment of the present invention, an ignition power source circuit is preferably a circuit including an energy storage condenser for storing electrical energy supplied to a first coil.

When such a circuit is used, the capacity of the energy storage condenser can be used to control electrical energy flowing to an electrical supply circuit (mentioned above) arranged to each cylinder. Therefore, if the electrostatic capacity of the condenser of an ignition power source device is set appropriately, then the electrical energy flowing to the electrical supply circuit can be suppressed appropriately.

This type of configuration enables the electrical supply circuit to be made compact and inexpensive, which further magnifies the effect of the present invention to enable the ignition device for an internal combustion engine to be made compact and inexpensive. Furthermore, the electrical supply circuit is preferably a circuit including an MOS-type field effect transistor.

Costs generally run high when such a circuit is used, and such an MOS-type FET is generally large in size. Since the present invention reduces the number of necessary MOS-type electrical field effect transistors (FETs), the effect of the present invention to keep down the costs associated with the device is particularly helpful.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

(First Embodiment)

Figure 1:
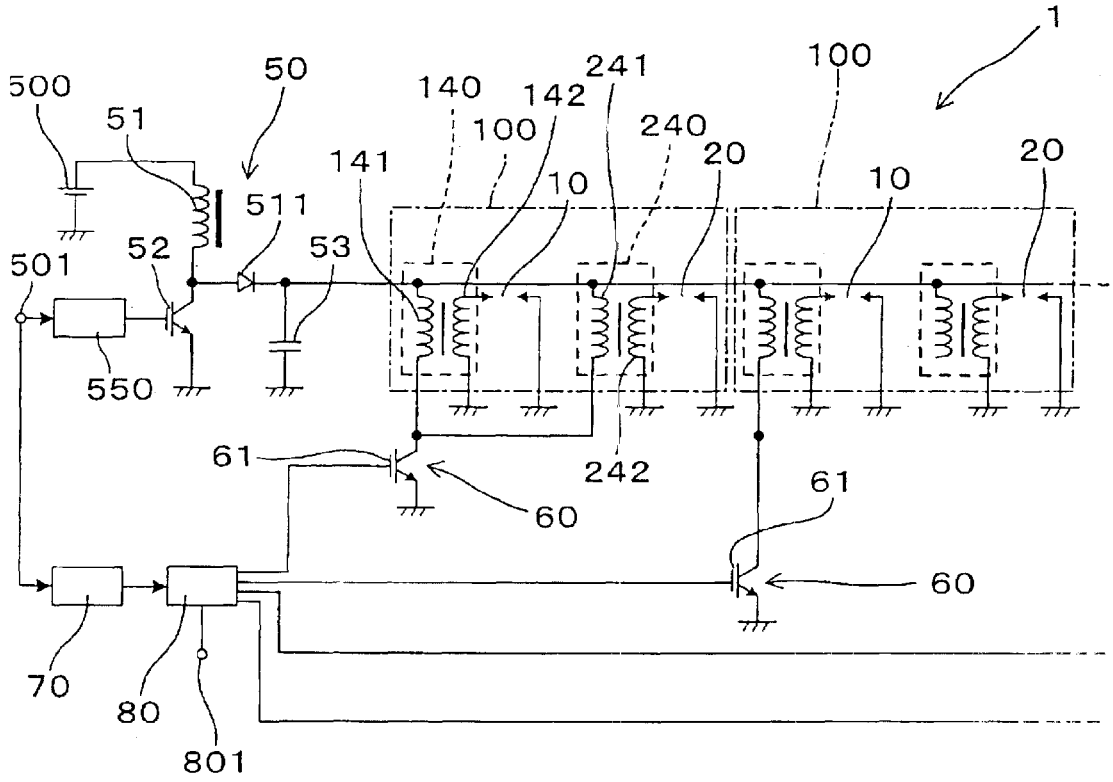
FIG. 1 is an equivalent circuit diagram showing an ignition device for an internal combustion engine according to a first embodiment.

FIG. 1 is an equivalent circuit diagram showing an ignition device 1 for an internal combustion engine according to the first embodiment. As shown in the diagram, the ignition device 1 has two spark plugs 10, 20 arranged at each cylinder 100 of an internal combustion engine (not shown in the diagram), ignition coils 140, 120 arranged independently to each of the spark plugs 10, 20 respectively, an ignition power source circuit 50 for supplying electrical energy to first coils 141, 241, which constitute the ignition coils 140, 240, and an electrical supply circuit 60 for switching on an off the electrical supply from the ignition power source circuit 50 to the first coils 141, 241. In the first embodiment, the electrical supply circuit 60 is constructed as an ignition transistor circuit, and is referred to below as an "ignition transistor circuit."

In this internal combustion engine ignition device 1, each of the first coils 141, 241 corresponding to each of the spark plugs 10, 20 arranged to the same cylinder 100 are arranged in parallel to the electrical supply circuit (ignition transistor circuit) 60, which is arranged to each of the cylinders 100. This is explained in detail below.

As shown in FIG. 1, the ignition coil 140 (240) is constituted by a combination of a second coil 142 (242) connected electrically to the spark plug 10 (20), and the first coil 141 (241), which supplies electrical power from the ignition power source circuit 50. This ignition coil 140 (240) is constructed so as to generate high voltage to the second coil 142 (242) by means of electromagnetic induction caused by switching the electrical supply to the first coil 141 (241).

As shown in FIG. 1, in the internal combustion engine ignition device 1 of the present embodiment, the coil tip at one end of the second coil 142 (242) is connected to a center electrode (not shown in the diagram) of the spark plugs 10 (20). The high voltage generated by the second coil 142 (242) is applied to the center electrode of each spark plug 10 (20), to cause a spark discharge to occur between the center electrode and a grounding electrode (not shown in the diagram).

As shown in FIG. 1, the coil tip at one end of the first coils 141, 241 in each of the ignition coils 140, 240 corresponding to each spark plug 10, 20 arranged to the same cylinder 100, is connected electrically to the ignition power source circuit 50. The ignition power source circuit 50 is a circuit for supplying electrical energy to the first coils 141, 241.

Furthermore, the other coil tip is grounded through the ignition transistor circuit 60, which includes a switching element 61 constituted of the MOS-type field effect transistor (FET) for switching the electrical supply from each ignition coil 140, 240 to the first coil 141, 241.

Note that, as shown in FIG. 1, the internal combustion engine ignition device 1 of the first embodiment is constructed such that all the ignition coils 140, 240 share the ignition power source circuit 50. Furthermore, the ignition transistor circuit 60 is provided to each cylinder 100. The first coils 141, 241 corresponding to each spark plug 10, 20 are arranged to the same cylinder 100 are connected parallel to the ignition transistor circuit 60.

As shown in FIG. 1, this ignition power source circuit 50 is a circuit constituted of an energy storage coil 51, a power transistor 52 for switching the electrical supply from the energy storage coil 51 on and off, and an energy storage condenser 53 for storing the energy from the energy storage coil 51. One end of the ignition power source circuit 50 is connected to the ignition coils 140, 240. The upstream end is connected to a power source 500. Furthermore, a base electrode of a power transistor 52 is connected to an output terminal of a closed angle/constant current control circuit 550. The power transistor 52 is constructed to perform switching operations according to controls by the closed angle/constant current control circuit 550.

As shown in FIG. 1, the closed angle/constant current control circuit 550 is constructed so as to control the power transistor 52 to start the electrical supply to the energy storage coil 51 upon the rising edge of an ignition signal Igt, and to stop the electrical supply to cut off the energy storage coil 51 upon the falling edge of the ignition signal Igt.

Furthermore, the closed angle/constant current control circuit 550 is constructed so as to perform feedback control on the power transistor 52 based on a value of the electrical current being supplied at the time when the electrical current is being supplied to the energy storage coil 51. Note that, as shown in FIG. 1, the closed angle/constant current control circuit 550 according to the present embodiment is connected through an input terminal 501 to an electronic control unit (not shown in the diagram, and referred to below as the "ECU") for calculating the ignition timing in each of the cylinders 100 to receive the ignition signal Igt from the ECU.

As shown in FIG. 1, the ignition transistor circuit 60 is a circuit having the switching element 61 for switching on and off the electrical supply, from the first coils 141, 241 in the ignition coils 140, 240, to the ground and a drive circuit (not shown in the diagram) for driving the switching element 61. Note that, in the present embodiment, the MOS-type FET is used as the switching element 61.

In particular, in the internal combustion engine ignition device 1 of the present embodiment, instead of arranging the ignition transistor circuit 60 to each of the spark plugs 10, 20, the ignition transistor circuit 60 is arranged to each of the cylinders 100. In other words, the first coils 141, 241 of the two ignition coils 140, 240 are arranged parallel to the commonly shared ignition transistor circuit 60.

Here, as shown in FIG. 1, the base electrode of the switching element 61 corresponding to each cylinder 100 is connected to an output terminal of an assigning circuit 80, which is connected to a monostable circuit 70.

The monostable circuit 70 is constructed to receive the ignition signal Igt from the ECU via the input terminal 501. It then outputs a high-level signal for a predetermined duration of time (which is set to approximately 2 ms in the present embodiment) simultaneously with the falling edge of the ignition signal Igt. Furthermore, the assigning circuit 80 is constructed to receive an ignition assignment signal for specifying an ignition cylinder from the ECU through an input terminal 801. It then outputs a signal, input from the monostable circuit 70, to the base electrode of the switching element 61 that corresponds to the specified ignition cylinder.

Next, the timing charts shown in FIGS. 2A through 2D will be used to explain operations of the internal combustion engine ignition device 1 of the first embodiment.

Figures 2A, 2B, 2C, 2D:
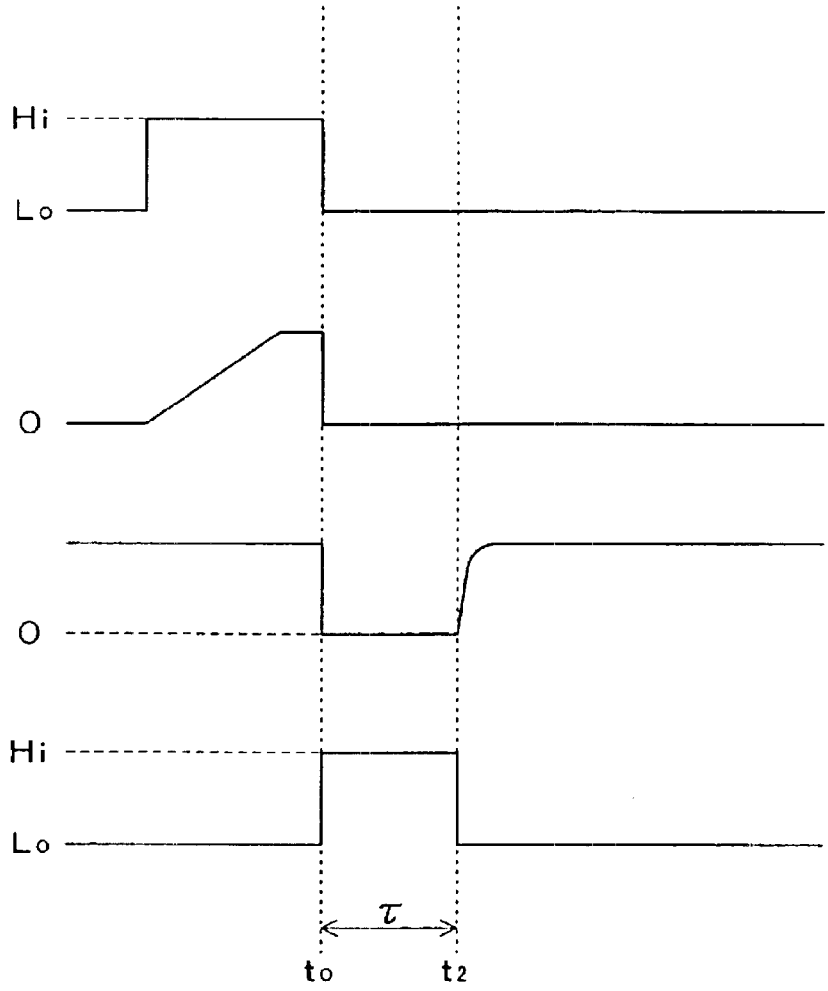
FIGS. 2A through 2D are timing charts showing ignition operations of the internal combustion engine ignition device according to the first embodiment.

Note that FIG. 2A shows the signal level of the ignition signal Igt output from the ECU. FIG. 2B shows the value of the electric current supplied to the energy storage coil 51, which is shown in FIG. 1. FIG. 2C shows voltages on both sides of the energy storage condenser 53, which is shown in FIG. 1. FIG. 2D shows voltage applied from the monostable circuit 70 to the base electrode of each switching element 61, via the assigning circuit 80.

First, as shown in FIG. 2A, when the ignition signal Igt from the ECU rises to a high-level, the closed angle/constant current control circuit 550 (see FIG. 1) performs control so that electricity is supplied to an emitter-collector of the power transistor 52.

As shown in FIG. 2B, when this occurs the electrical current supplied from the power source 500 (see FIG. 1) flows to the energy storage coil 51. Here, the closed angle/constant current control circuit 550 performs feedback control on the power transistor 52 based on the electrical current value detected by an electrical current detection resistor (not shown in the diagram), to keep the electrical current at a given value.

As shown in FIG. 2B, the result of this is that the electrical current supplied to the energy storage coil 51 increases in a monotonous fashion at first, and then gets set at a constant electrical current value. At that time, magnetic energy which has been converted from electrical energy gets stored in the energy storage coil 51.

After that, at time t0, when the ignition signal Igt from the ECU falls to a low-level, the closed angle/constant current control circuit 550 cuts off the electrical supply from the power transistor 52. As shown in FIG. 2D, the ignition signal Igt from the ECU falling to a low-level simultaneously triggers the monostable circuit to maintain the high-level signal for a predetermined duration of time $\tau$, which is approximately 2 ms in the first embodiment.

Then, this high-level signal is applied through the assigning circuit 80 to the base electrode of the switching element 61 corresponding to the specified cylinder 100, and then the switching circuit 61 shifts to supply electricity.

As described above, when the electrical supply from the power transistor 52 is cut off and the electrical supply from the switching elements 61 (62) is started, the magnetic energy stored in the energy storage coil 51 as described above gets discharged. Then, the magnetic energy is simultaneously supplied as electrical energy to each of the first coils 141, 241 which are connected in parallel with the switching element 61.

When this happens, high voltage is generated in the second coils 142, 242 in the ignition coils 140, 240 (which are constituted by a combination of the first coils 141, 241 and the second coils 142, 242), due to the electromagnetic induction which occurs when the electrical supply to the first coils 141, 241 starts abruptly. Then, when the high voltage generated in the second coils 142, 242 is applied to the spark plugs 10, 20, sparks caused by spark discharge occur between the center electrode and the grounded electrode of each of the spark plugs 10, 20.

Note that the spark discharge caused by the spark plugs 10, 20 continues until a discharge current from the energy storage coil 51 drops below a predetermined electrical current value. Here, the monostable circuit 70 (FIG. 1) of the present embodiment is set to the predetermined duration of time $\tau$ (see FIG. 2D), which is even longer than the time duration of the spark discharge. After the spark discharge stops, the electrical supply from the switching element 61 still continues.

After the spark discharge stops, the continuing electrical supply from the switching element 61 enables the electrical supply to be maintained from the power source 500 through the energy storage coil 51, and from the first coils 141, 241 all the way to the ground. By maintaining the power supply from the energy storage coil 51, the re-accumulation of magnetic energy in the energy storage coil 51 can be achieved. Then, when the output signal from the monostable circuit 70 falls to a low-level at a time t2, the electrical supply from the switching element 61, which was turned on up to that point, is then turned off.

As shown in FIG. 2C, when this occurs the magnetic energy stored in the energy storage coil 51 is supplied to the energy storage condenser 53 via a diode 511 to recharge the energy storage condenser 53. Note that the electrical energy stored in the energy storage condenser 53 is combined with the magnetic energy from the energy storage coil 51 and is supplied as the electrical energy for the ignition coils 140, 240. Then, when the ECU outputs the ignition signal Igt once again, the sequence described above is repeated for a different cylinder 100, and the storage of the electrical energy by the ignition power source circuit 50 and the spark discharge by the spark plugs 10, 20 are repeated.

As described above, in the internal combustion engine ignition device 1 of the present embodiment, the single ignition transistor circuit 60 is shared by each of the ignition coils 140, 240 corresponding to the spark plugs 10, 20 arranged at the same cylinder 100.

Therefore, even in the case where there are two or more spark plugs to a cylinder, the same circuit construction can be used as in the case where there is only one for each cylinder. As a result, the internal combustion engine ignition device 1 of the present embodiment can prevent increased costs due to increased plugs (i.e., multiple spark plugs for each cylinder) and increased size of the ignition device while enjoying the beneficial effects of multiple plugs, such as the ability to make combustion adjustments, decreased fuel consumption due to improved fuel efficiency, and the like.

Note that, instead of supplying the energy stored in the energy storage condenser 53 and the energy storage coil 51 to the ignition coils 140, 240 as in the present embodiment, it is also possible to employ a general capacitive discharge-type ignition device in which the energy is supplied to the ignition coil from the energy storage condenser only.

(Second Embodiment)

Figure 3:
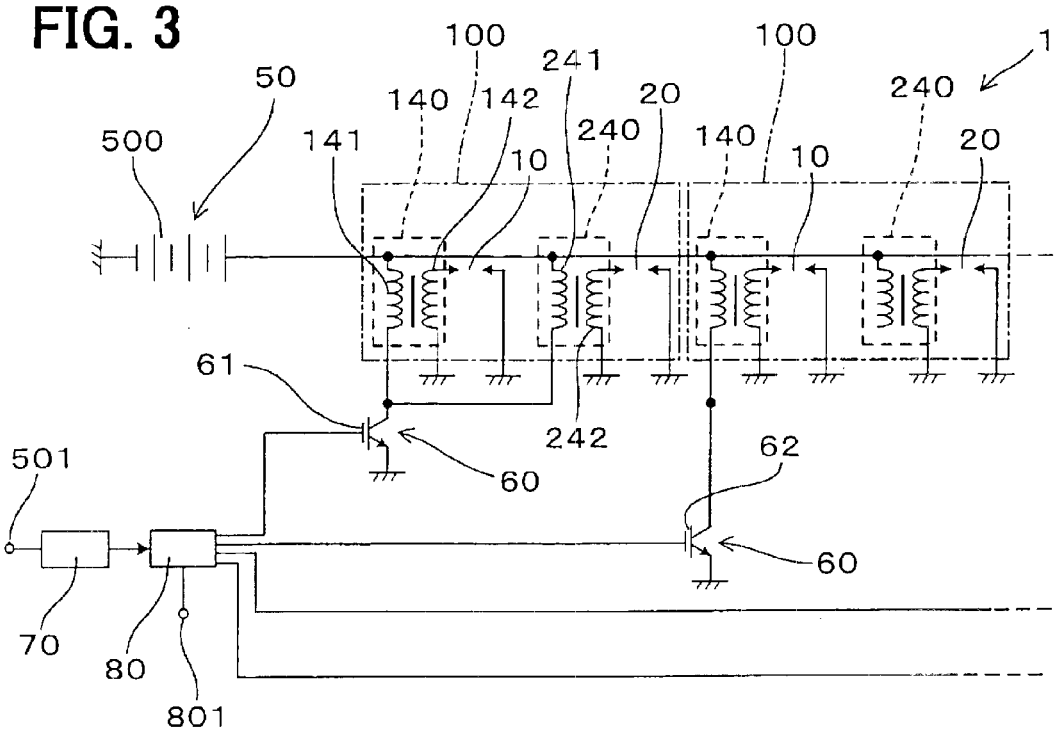
FIG. 3 is an equivalent circuit diagram showing an ignition device for an internal combustion engine according to a second embodiment.

The second embodiment is based on the ignition device for an internal combustion engine of the first embodiment, with a modified method of performing the ignition. As shown in FIG. 3, instead of using the CDI method used in the first embodiment, the second embodiment is constructed using a full transistor method. Note that other constructions and effects of the invention are similar to the first embodiment.

(Third Embodiment)

In the third embodiment, the amount of the electrical current flowing to the first coil in the ignition coil, and the size of the electrical current flowing to the ignition transistor circuit, will be compared against those in the internal combustion engine ignition device using the CDI method of the first embodiment, and those in the internal combustion engine ignition device using the full transistor method of the second embodiment. FIG. 4A through FIG. 5C are used to describe the third embodiment.

Figure 4A:
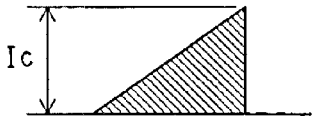
FIGS. 4A through 4C are diagrams of electrical currents flowing to ignition coils and an ignition transistor circuit of an ignition device for an internal combustion engine using a CDI method in a third embodiment.
Figure 4B:
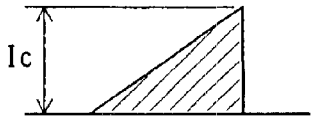
Figure 4C:
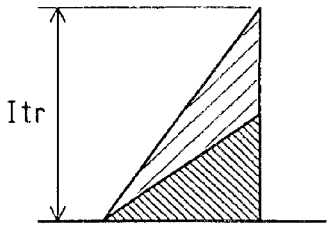

FIGS. 4A and 4B show an electrical current Ic flowing to the first coil of each ignition coil corresponding to the two spark plugs arranged at the specified cylinder 100, in accordance with the internal combustion engine ignition device using the CDI method. FIG. 4C shows an electrical current Itr flowing to the switching element of the ignition transistor circuit.

Figure 5A:
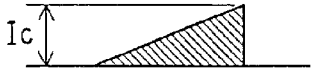
FIGS. 5A through 5C are diagrams of electrical currents flowing to ignition coils and an ignition transistor circuit according to an ignition device for an internal combustion engine using a full transistor method in the third embodiment.
Figure 5B:
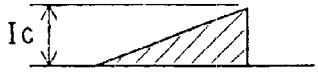
Figure 5C:
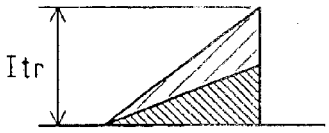

On the other hand, FIGS. 5A and 5B show an electrical current Ic flowing to the first coil of each ignition coil corresponding to two spark plugs arranged at the specified cylinder 100, in accordance with the internal combustion engine ignition device using the full transistor. FIG. 5C shows an electrical current Itr flowing to the switching element of the ignition transistor circuit.

According to FIG. 4A through FIG. 5C, the electrical current Itr flowing to the switching element of the ignition transistor circuit is the sum of the electrical currents Ic flowing to the first coils of each ignition coil. Therefore, in the case where two or more spark plugs are provided to a single cylinder, the capacity of the switching element must be large if the ignition transistor circuit is being shared.

On other hand, when the CDI method is being used as shown in FIGS. 4A through 4C, the electrical current Itr flowing to the switching element of the ignition transistor circuit can be kept smaller than in the case where the full transistor method is used as shown in FIGS. 5A through 5C. This is because when the CDI method is being used, the capacity of the energy storage condenser can be used to control the electrical energy flowing to the switching element of the ignition transistor circuit.

Therefore, when the CDI method is used, the electrostatic capacity of the energy storage condenser can be optimally adjusted to suppress the electric current Itr flowing to the switching element of the ignition transistor circuit. Thus, a small-capacity, low-cost, small-size element can be used for the switching element. Additionally, the CDI method further promotes the effects of the present invention so as to enable a cost reduction and a more compact construction in the internal combustion engine ignition device built with multiple plugs for each cylinder.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition device for an internal combustion engine, comprising:

a plurality of spark plugs provided to an ignition apparatus, wherein the plurality of spark plugs are provided in each internal combustion engine cylinder;

an ignition coil independently arranged corresponding to each of the spark plugs;

an ignition power source circuit for supplying electrical energy to a first coil which is part of the ignition coil; and an electrical supply circuit for switching on and off an electrical supply from the ignition power source circuit to the first coil, wherein the plurality of first coils corresponding to the plurality of spark plugs arranged to the same single cylinder are connected in parallel with the single electrical supply circuit arranged to each cylinder, and the electrical supply circuit simultaneously supplies electricity to the plurality of first coils corresponding to the plurality of spark plugs arranged to the same cylinder.

2. The ignition device for an internal combustion engine according to claim 1, wherein the ignition power source circuit is a circuit including an energy storage condenser for storing electrical energy supplied to the first coil.

3. The ignition device for an internal combustion engine according to claim 1, wherein the electrical supply circuit is a circuit including an MOS-type field effect transistor.

* * * * *